US009679720B1

(12) United States Patent
Bugryn

(10) Patent No.: US 9,679,720 B1
(45) Date of Patent: Jun. 13, 2017

(54) ARC MOTIVATION DEVICE

(71) Applicant: James Bugryn, Bristol, CT (US)

(72) Inventor: James Bugryn, Bristol, CT (US)

(73) Assignee: Carling Technologies, Inc., Plainville, CT (US)

( * ) Notice: Subject to any disclaimer, the term of this patent is extended or adjusted under 35 U.S.C. 154(b) by 0 days.

(21) Appl. No.: 15/148,457

(22) Filed: May 6, 2016

(51) Int. Cl.
*H01H 33/18* (2006.01)
*H01H 33/08* (2006.01)

(52) U.S. Cl.
CPC ..... *H01H 33/182* (2013.01); *H01H 33/08* (2013.01)

(58) Field of Classification Search
CPC ..... H01H 33/182; H01H 2205/002; H01H 50/18; H01H 50/36; H01H 50/56; H01H 51/065; H01H 85/0241; H01H 9/443; H01H 1/02; H01H 1/20; H01H 1/36; H01H 1/385; H01H 1/54; H01H 2003/268; H01H 2009/188
See application file for complete search history.

(56) References Cited

U.S. PATENT DOCUMENTS 5,109,146 A * 4/1992 Maenishi ..... H01H 9/443 218/26
7,679,020 B2 * 3/2010 Schulz ..... H01H 9/443 218/24
8,519,292 B2 * 8/2013 Domejean ..... H01H 9/346 218/149
8,822,866 B2 9/2014 Fasano
8,853,586 B2 * 10/2014 Theisen ..... H01H 1/2066 218/26
8,947,181 B2 * 2/2015 Malingowski ..... H01H 9/46 218/32
2012/0037598 A1 2/2012 Fasano
2012/0261382 A1 10/2012 Fasano
2013/0284702 A1 * 10/2013 Hamada ..... H01H 9/302 218/26

* cited by examiner

*Primary Examiner* — Truc Nguyen
(74) *Attorney, Agent, or Firm* — St. Onge Steward Johnston & Reens, LLC

(57) ABSTRACT

A circuit interrupter including an arc extinguisher which functions to arrest an arc that develops between electrical contacts. The circuit interrupter includes a permanent magnet coupled at opposite ends to two magnetically permeable pole pieces that are configured to drive or urge an arc into toward an arc extinguisher. The device allows for arc motivation due to the magnetic field without requiring the use of electrical power and allows for a rugged, light-weight design.

17 Claims, 4 Drawing Sheets

ARC MOTIVATION DEVICE

FIELD OF THE INVENTION

The present invention relates generally to the protection of electrical devices, and more specifically, to arc extinguishing structures that are configured to rapidly extinguish an electrical arc using fewer parts than known methods to reduce manufacturing costs and provide a more compact, lighter weight device.

BACKGROUND OF THE INVENTION

Circuit interrupters are electrical components that are used to open an electrical circuit, interrupting the flow of current. One example of a circuit interrupter is a switch, which typically includes two electrical contacts in one either a closed state or an open state thereby opening or closing an electrical circuit.

Another example of a circuit interrupter is a circuit breaker. A circuit breaker may be used, for example, in an electrical panel to limit the amount of current allowed to flow through attached electrical wiring. A circuit breaker is designed to protect an electrical circuit from damage caused by various dangerous fault situations that may develop in an electrical circuit including but not limited to, an overload, a ground fault or a short circuit. If a fault condition, such as, a power surge occurs in the electrical circuit, the breaker will trip open thereby interrupting the supply of electrical power to the circuit. Circuit breakers are generally provided to protect the electrical wiring by limiting the amount of current transmitted through the wires to a level that will not damage them. Circuit breakers can also prevent destruction of the devices that may draw too much current. Some common types of circuit interrupters include: thermal magnetic circuit breakers, inverse time circuit breakers and instantaneous-trip circuit breakers.

Most circuit breakers have a "line" terminal connectable to an electrical power source, such as, a power line electrically connected to the secondary of a power company transformer. Additionally, most circuit breakers further include a "load" terminal electrically connectable to the circuit (i.e., the wiring) that the circuit breaker is intended to protect.

Typically, a single pole circuit interrupter has two contacts positioned inside of a housing or enclosure. The first contact is stationary and may be connected to either the line or the load. The second contact is movable with respect to the first contact, such that, when the circuit breaker is in the "off" or tripped position, a physical gap exists between the first and second contact.

A problem with the above-described circuit interrupters arises when energized contacts are transitioned from a closed state (in which current is flowing across the contacts) to an opened state (in which current is interrupted from flowing) while under load. As the contacts separate transitioning from a closed to an open state, or when the opposite occurs, when the contacts transition from an opened state to a closed state, an electric arc may form in the gap (the physical space) between the contacts as the contacts are drawn apart.

The development of an arc during switching or tripping of the circuit interrupter negatively affects the overall operation of the circuit interrupter, even potentially creating safety hazards.

These negative effects can have adverse consequences on the operation of the circuit interrupter. One possible consequence is that the arc may short to other objects in the circuit interrupter and/or to surrounding objects, causing damage and presenting a potential fire or safety hazard.

Another consequence of arcing is that the arc energy damages the contacts, causing some material to escape into the air as fine particulate matter. The debris which has been melted off of the contacts can migrate or be flung into the mechanism of the circuit interrupter, destroying the mechanism or reducing its operational lifespan.

Another effect of arcing stems from the extremely high temperature of the arc (tens of thousands of degrees Celsius), which can impact the surrounding gas molecules creating ozone, carbon monoxide, and other dangerous compounds. The arc can also ionize surrounding gasses, potentially creating alternate conduction paths.

Because of these detrimental effects it is very important to quickly cool and quench the arc to prevent damage to the circuit interrupter and the above-described dangerous situations.

Various techniques for improved arc quenching are known. For example, U.S. Published Patent Applications No. 2012/0037598 and 2012/0261382, assigned to Carling Technologies, Inc., variously relate to the use of an electromagnetic field to guide an arc toward an arc splitter.

However, generating an electromagnetic field to move an arc typically requires the use of electrical power, which in turn, will generate heat in the device. This is undesirable from the standpoint that the excessive heat will need to be dispersed; but additionally, this requires utilization of additional power, thereby making the system less energy efficient.

It is therefore desired to provide arc quenching usable with a circuit interrupter that overcomes the above-described limitations.

SUMMARY OF THE INVENTION

Accordingly, it is an object to provide a circuit interrupter having an arc extinguisher that functions to arrest an arc between the circuit interrupter contacts.

It is another object to provide a circuit interrupter that provides for arc suppression but that does not consume electrical power.

It is a further object to provide a circuit interrupter that provides for arc suppression while simultaneously providing a rugged, light-weight device, which has a lower manufacturing cost from known systems.

These and other objectives are achieved by providing a circuit interrupter that includes a first contact and a second contact movable into and out of electrical contact with each other; an arc extinguisher; a single permanent magnet disposed to guide an arc that develops between the contacts into the arc extinguisher.

In some implementations, the arc extinguisher comprises a first arc path and a second arc path. The first arc path may, for example, extend in a direction substantially parallel to the second arc path.

As an example, the circuit interrupter may include a single permanent magnet positioned in the circuit interrupter. The single permanent magnet include two ends, the first end having a positive polarity and the second end having a negative polarity. Additionally, two pole pieces, each comprising a magnetically permeable material, may be positioned, in one example, in physical contact with each end of the permanent magnet such that the first pole piece takes on a positive polarity and the second pole piece takes on a negative polarity. The two pole pieces may be positioned perpendicular to the single permanent magnet and extend substantially parallel to and slightly apart from each other. In this manner, a magnetic field extends across the gap formed between the pole pieces due to the differing polarity of the pole pieces. The contacts may then be placed or positioned in the gap that is permeated by the magnetic field.

An arc extinguisher for extinguishing an arc that develops in the vicinity of said first and second contacts may further be positioned in the vicinity of the contacts and in proximity to the magnetic field that permeates the gap between the pole pieces. In this manner, the magnetic field that extends across and permeates the gap formed between the first and second pole pieces such that, when an arc forms in the gap (e.g., across the contacts), the arc is urged in a direction toward the arc extinguisher.

In some implementations, the permanent magnet may be a hollow square or some other suitable shape. The use of the permanent magnet allows for the system to generate a magnetic field without consuming any electrical power. Likewise, because no electrical power is consumed, there is no attendant heat to be dissipated by the device.

It should be noted that as only one permanent magnet is used, the device will be relatively light weight. Likewise, as the pole pieces are used to "transmit" and maintain a magnetic field in a manner desired to envelope the contacts, the system is very rugged as the pole pieces are non-moving parts that are connected to the permanent magnet and typically formed of a steel material.

Still further, the magnetic field produced by the permanent magnet may interact with a magnetic field produced by the arc (the arc, having an electric charge will therefore also have an associated magnetic charge), such that the arc is directed toward the arc extinguisher regardless of whether the arc is emitted from the first contact or the second contact.

In some implementations, the arc extinguisher comprises at least one plate for splitting the arc into a first arc path and a second arc path. The first arc path may comprise a first plate and the second arc path may comprise a second arc plate that is different from the first arc plate. The first arc path and the second arc path may comprise a common arc runner. The circuit interrupter may include a lower arc runner in electrical contact with the first contact and having a first tab extending beneath the first arc path and a second tab extending beneath the second arc path.

In one example, a circuit interrupter including arc suppression is provided including a first contact electrically connectable to a power source and a second contact electrically connectable to a load. The circuit interrupter is provided such that the first and second contacts are movable between a closed and open position relative to each other. The circuit interrupter further includes an arc extinguisher for extinguishing an arc that develops in the vicinity of the first and second contacts and a permanent magnet disposed adjacent to at least one of the contacts, the permanent magnet having a first end having a first magnetic polarity and a second end having a second magnetic polarity opposite to the first magnetic polarity, the permanent magnet generating a magnetic field. The circuit interrupter still further includes a first pole piece comprising a magnetically permeable material and a second pole piece comprising a magnetically permeable material. The circuit interrupter is provided such that the first pole piece is positioned adjacent to the first end having the first magnetic polarity and the second pole piece is positioned adjacent to the second end having the second magnetic polarity. Finally, the circuit interrupter is provided such that the magnetic field extends across a gap formed between the first and second pole pieces where an arc that forms in the gap is drawn in a direction toward the arc extinguisher.

Other objects of the invention and its particular features and advantages will become more apparent from consideration of the following drawings and accompanying detailed description.

DETAILED DESCRIPTION OF THE INVENTION

Figure 1:
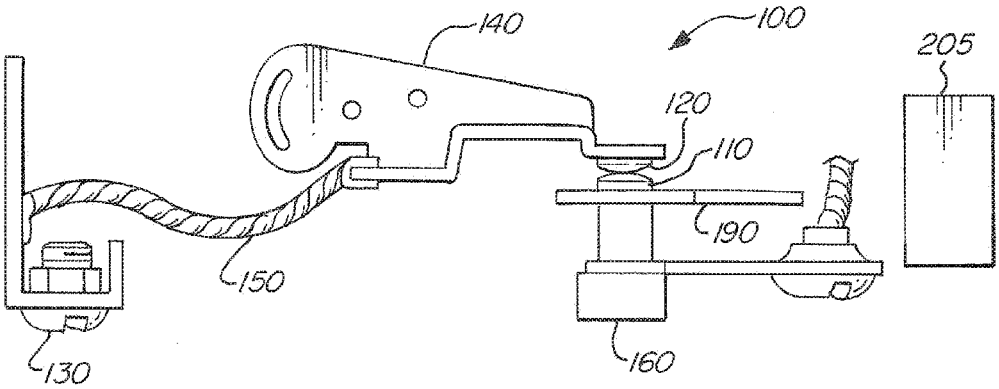
FIG. 1 illustrates components of an example circuit interrupter according to aspects of the invention.

FIG. 1 illustrates components of an example circuit interrupter 100 having magnetic arc extinguishment features according to aspects of the invention.

Circuit interrupter 100 may be any device which can be used to make and break an electrical circuit. For example, it will be clear to those of skill in the art that circuit interrupter 100 may comprise a switch, or may be implemented as a circuit breaker.

Circuit interrupter 100 includes stationary contact 110, which is electrically connected to line terminal (not shown). The line terminal receives electrical power from a power source (not shown), which in some applications is supplied by a power company. It will, however, be understood by those of skill in the art that the power may be provided and conditioned by any commercial means including, but not limited to, a commercial electrical power grid, a generator(s), solar panels, fuel cells, and so on.

A movable contact 120 is disposed on a movable contact arm 140, which is movable between a closed and an open position relative to the stationary contact 110. In FIG. 1, contact arm 140 is shown in a closed position, with movable contact 120 physically contacting stationary contact 110. It will be understood by those of skill in the art that contact arm 140 may be moved upward rotating about a pivot point such that moveable contact 120 is moved out of physical contact with stationary contact 110.

Movable contact 120 is connected to load terminal 130 through a conductor 150. When contact arm 140 is in the closed position as shown, movable contact 120 is electrically connected to stationary contact 110 such that electrical current is allowed to flow between line terminal and load terminal.

Pole pieces 170 and 170' (FIGS. 2-6), may be disposed on opposite sides of the contacts 110, 120 and oriented to produce magnetic fields through the region where an arc may form between contacts 110, 120. A permanent magnet 160 may further be positioned below stationary contact 110 and movable contact 120, and oriented such that the pole pieces 170, 170' are in physical contact with opposite ends of the permanent magnet 160.

Contact arm 140 may be actuated via a switch, trip mechanism, and/or any other known mechanism (not shown) depending on the desired implementation of circuit interrupter 100.

It will be understood that pole pieces 170, 170' will need to be positioned in such a manner that they do not obstruct the travel of contact arm 140. This arrangement provides the advantage of creating magnetic fields, which maintain a desired field strength and direction over the expected travel path of an arc generated between contacts 110, 120. In the example depicted in FIG. 5, pole pieces 170 and 170' are oriented such that the magnetic field produced by magnet 160 flows from one pole piece to the other and encourages an arc toward arc extinguisher 205.

Figure 2:
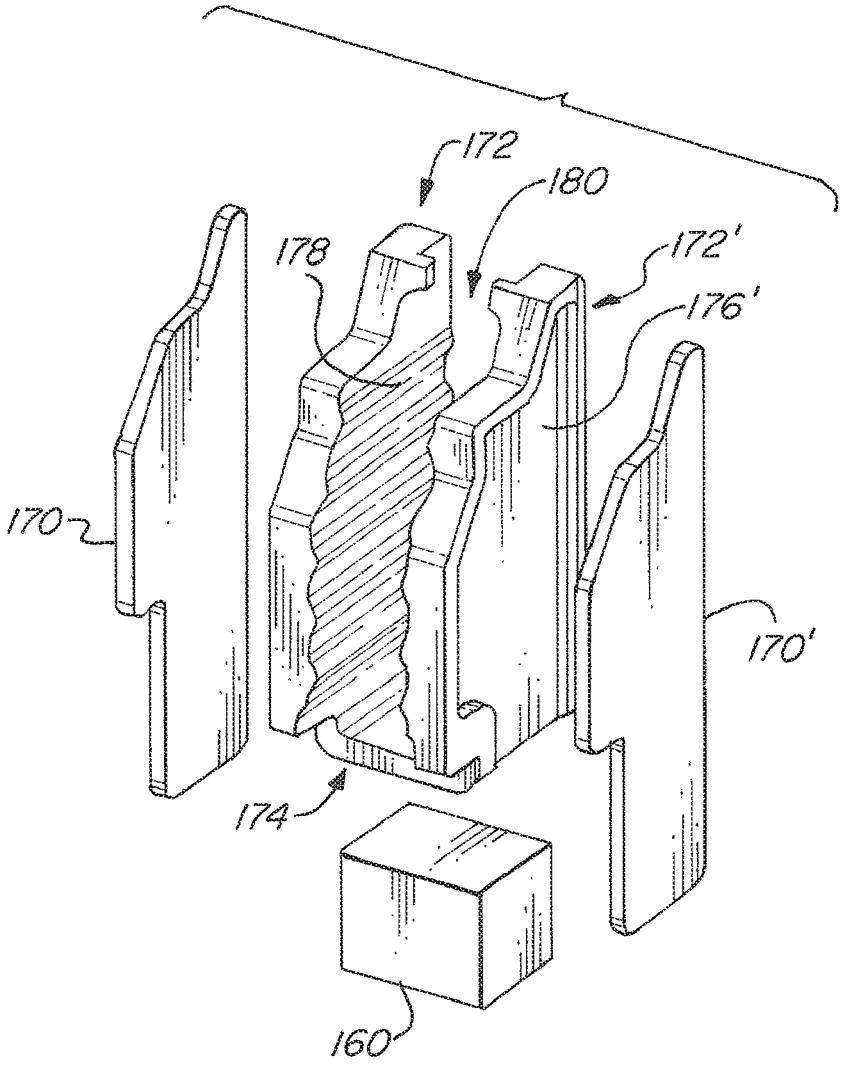
FIG. 2 is an exploded view of two pole pieces, a magnet and a retainer according to aspects of the invention.

FIG. 2 provides an exploded view of a portion of the circuit interrupter 100 illustrating an example of one configuration for the pole pieces 170, 170' and the permanent magnet 160. In this example, a structure comprising a non-magnetic material is provided including two upturned pieces 172, 172' that run essentially parallel to each other and are connected at a lower end by an end piece 174 that also comprises a non-magnetic material. The two upturned pieces 172, 172' and the end piece 174, may in one example, comprise a single unitary structure.

Provided on an exterior surface of the upturned piece 172' is a cavity 176' that is provided substantially to receive pole piece 170' therein. While not depicted, it should be understood that a corresponding cavity is provided on an exterior surface of upturned piece 172 that is provided to receive the corresponding pole piece 170 therein.

On an interior surface of upturned piece 172 are raised protrusions 178 that are provided traverse to a longitudinal length of upturned piece 172. While five (5) protrusions 178 are illustrated in the drawing, it will be understood by one of skill in the art that any number may be provided.

The permanent magnet 160 is provided below and is affixed, in one example, to end piece 174. The pole pieces 170, 170' are fitted into their respective cavities of upturned pieces 172, 172' such that the lower ends of the pole pieces 170, 170' come into contact with opposite ends of permanent magnet 160. This functions to magnetize the pole pieces 170, 170' in a manner consistent with the magnetic polarity of the end of the permanent magnet 160 they are connected to. In other words pole pieces 170, 170' will assume opposite polarities.

Figure 5:
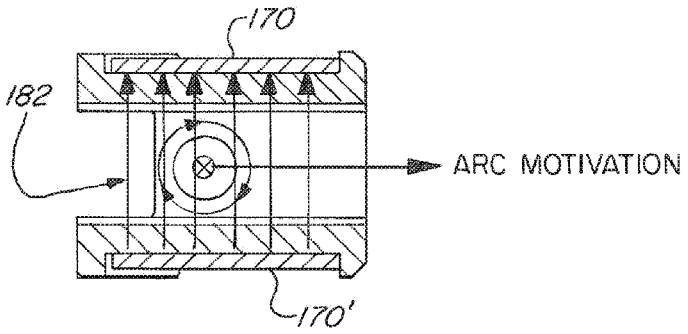
FIG. 5 is a section view along section B-B of FIG. 3.
Figure 3:
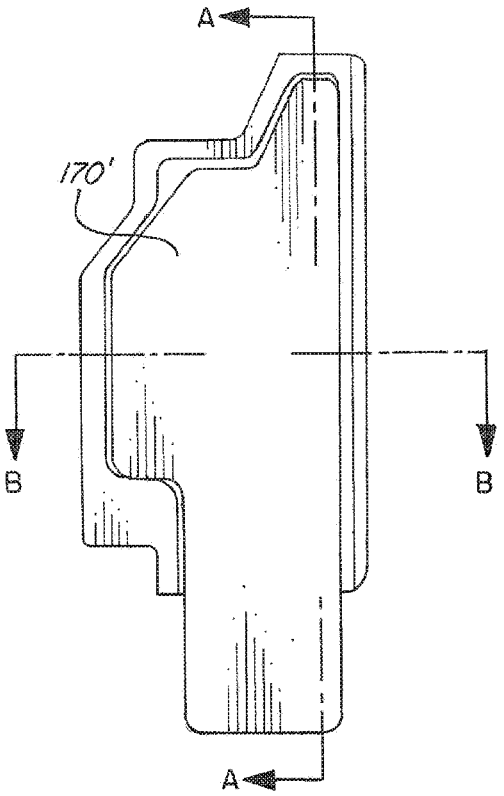
FIG. 3 is a side view according to FIG. 2.
Figure 4:
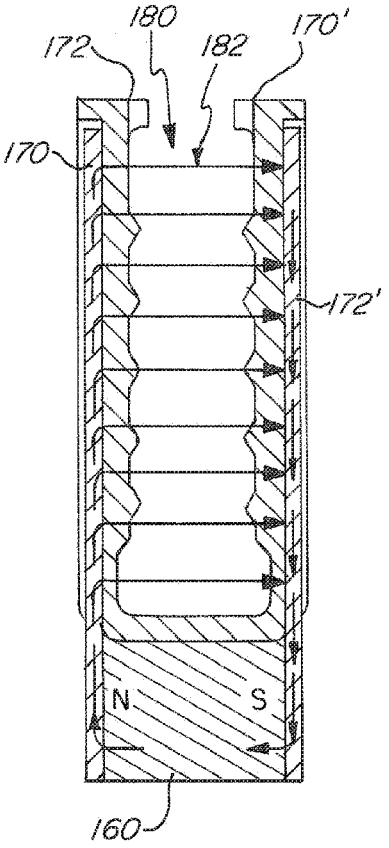
FIG. 4 is a section view along section A-A of FIG. 3.

Turning now to FIGS. 3-5, FIG. 3 illustrates a side view of the pole piece 172' with two section views (A-A and B-B) indicated thereon.

FIG. 4 is a drawing according to FIG. 3 along section line A-A showing the permanent magnet 160 coupled to both pole pieces 170, 170', which are fitted into the cavities of upturned pieces 172, 172'. In this example, the upturned pieces 172, 172' and end piece 174 are all formed of a non-magnetic material as a single unitary structure. Also illustrated in FIG. 4 are magnetic lines of force 182, which are provided to illustrate the magnetic field that is developed in the gap 180 between pole pieces 170, 170'. The function of the magnetic field 182 will be discussed in greater detail in connection with FIG. 6.

FIG. 5 is a drawing according to FIG. 3 along section line B-B showing both pole pieces 170, 170' and the interaction of the magnetic field 182 with and arc that forms in the gap 180.

Figure 6:
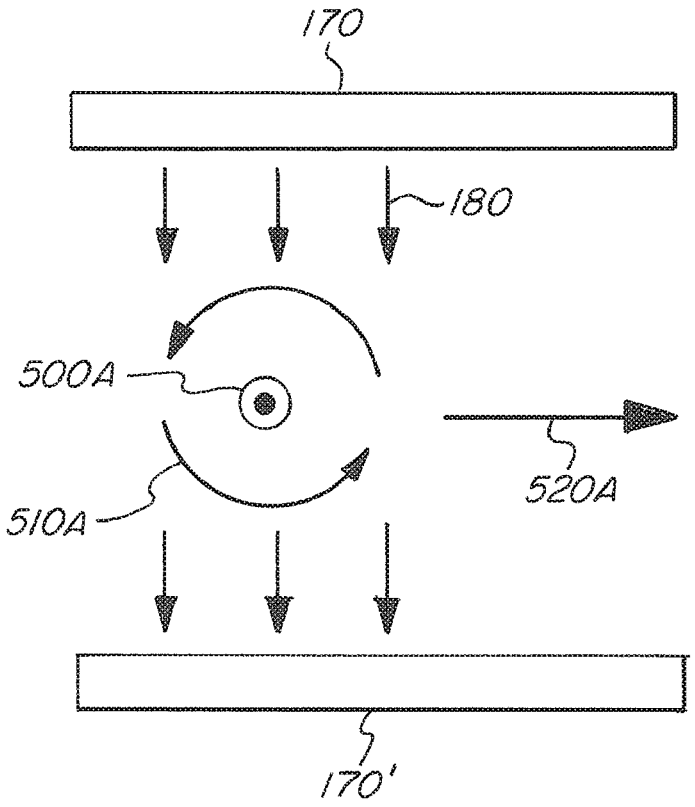
FIG. 6 is an overhead view according to FIG. 1.

FIG. 6 is a top view of pole pieces 170, 170' and illustrates the effect of magnetic field 182 upon an arc developing between contacts 110, 120.

For example, in FIG. 6, an arc 500A is illustrated developing between stationary contact 110 and movable contact 120. An electromagnetic field 510A surrounding arc 500A is developed in a counter-clockwise direction as indicated. Electromagnetic field 510A interacts with magnetic field 180 to move arc 500A in the direction illustrated by arrow 520A (i.e., to the right in FIG. 6). Referring to the corresponding structures in FIG. 1, this movement will drive the arc 500A toward arc extinguisher 205 to be extinguished.

Although the invention has been described with reference to a particular arrangement of parts, features and the like, these are not intended to exhaust all possible arrangements or features, and indeed many modifications and variations will be ascertainable to those of skill in the art.

What is claimed is:

1. A circuit interrupter including arc suppression comprising:

a first contact electrically connectable to a power source;

a second contact electrically connectable to a load;

said first and second contacts being movable between a closed and open position relative to each other;

an arc extinguisher for extinguishing an arc that develops in the vicinity of said first and second contacts;

a permanent magnet disposed in the vicinity of at least one of the contacts, said permanent magnet having a first end having a first magnetic polarity and a second end having a second magnetic polarity opposite to the first magnetic polarity, said permanent magnet generating a magnetic field;

a first pole piece comprising a magnetically permeable material;

a second pole piece comprising a magnetically permeable material, said second pole piece positioned apart from and substantially parallel with said first pole piece to form a gap where said first and second contacts are positioned;

said first pole piece positioned adjacent to the first end having the first magnetic polarity and said second pole piece positioned adjacent to the second end having the second magnetic polarity;

a non-magnetic pole structure having:

a first non-magnetic pole piece extending along a longitudinal length of said first pole piece and positioned in the gap between said first pole piece and said contacts;

a second non-magnetic pole piece extending along a longitudinal length of said second pole piece and positioned in the gap between said second pole piece and said contacts; and a non-magnetic connecting portion connecting one end of said first non-magnetic pole piece to one end of said second non-magnetic pole piece, said non-magnetic connecting portion positioned in the gap between said permanent magnet and said contacts;

wherein the magnetic field extends across a gap formed between the first and second pole pieces such that an arc that forms in the gap is drawn in a direction toward said arc extinguisher.

2. The circuit interrupter according to claim 1 wherein said first non-magnetic pole piece extends a longitudinal length that is substantially equal to a longitudinal length of said first pole piece, and said second non-magnetic pole piece extends a longitudinal length that is substantially equal to a longitudinal length of second first pole piece.

3. The circuit interrupter according to claim 1 wherein said non-magnetic connecting portion is formed as a magnet retainer.

4. The circuit interrupter according to claim 3 wherein said first and second non-magnetic pole pieces and said magnet retainer are all formed as a single unitary structure comprising a non-magnetic structure.

5. The circuit interrupter according to claim 4 wherein an exterior surface of said first and second non-magnetic pole pieces each comprise a cavity with a raised perimeter edge that extends at least partially around a perimeter of each of said first and second non-magnetic pole pieces.

6. The circuit interrupter according to claim 5 wherein each of said first and second pole pieces are positioned in the respective cavities located in the exterior surfaces of each of said first and second non-magnetic pole pieces.

7. The circuit interrupter according to claim 6 wherein the raised perimeter edges extends upwards from the exterior surface of said first and second non-magnetic pole pieces such that they are essentially flush with an outer surface of the respective pole piece positioned in the respective cavity.

8. The circuit interrupter according to claim 4 wherein an interior surface of said first and second non-magnetic pole pieces each comprise a plurality of raised portions that run traverse to a longitudinal length of said first and second non-magnetic pole pieces.

9. The circuit interrupter according to claim 1 wherein said permanent magnet consists of a single permanent magnet having rectangular shape.

10. The circuit interrupter according to claim 1 wherein said first and second pole piece each comprise steel.

11. The circuit interrupter according to claim 1 wherein said first pole piece comprises a flat structure having a width and a longitudinal length defined by a first end and a second end, where the longitudinal length is greater than the width.

12. The circuit interrupter according to claim 11 wherein the first end of said first pole piece is positioned in the vicinity of the first end of said permanent magnet, and a width of the first end of the first pole piece is greater than a width of the second end of the first pole piece.

13. The circuit interrupter according to claim 1 said first pole piece is positioned in contact with the first end of said permanent magnet and said second pole piece is positioned in contact with the second end of said permanent magnet.

14. The circuit interrupter of claim 1, wherein said arc extinguisher comprises a first arc path and a second arc path.

15. The circuit interrupter of claim 14, wherein the first arc path extends in a direction substantially parallel to the second arc path.

16. The circuit interrupter of claim 14, wherein the first arc path extends in a direction substantially perpendicular to the second arc path.

17. The circuit interrupter of claim 1, wherein said first and second contacts are positioned one above the other and said permanent magnet is positioned below both said first and second contacts.

* * * * *